US008251473B2

(12) United States Patent
Moriyama et al.

(10) Patent No.: US 8,251,473 B2
(45) Date of Patent: Aug. 28, 2012

(54) INKJET PRINTING APPARATUS

(75) Inventors: Jiro Moriyama, Kawasaki (JP); Hidehiko Kanda, Yokohama (JP); Atsuhiko Masuyama, Yokohama (JP); Masahiko Umezawa, Kawasaki (JP); Hideaki Takamiya, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 977 days.

(21) Appl. No.: 12/114,923

(22) Filed: May 5, 2008

(65) Prior Publication Data

US 2008/0284823 A1 Nov. 20, 2008

(30) Foreign Application Priority Data

May 11, 2007 (JP) ..... 2007-126400

(51) Int. Cl.
*B41J 29/38* (2006.01)
*B41J 2/05* (2006.01)

(52) U.S. Cl. ..... 347/14; 347/57

(58) Field of Classification Search ..... 347/14, 347/57

See application file for complete search history.

(56) References Cited

U.S. PATENT DOCUMENTS

| | | | | |
|---|---|---|---|---|
| 5,646,659 | A | 7/1997 | Moriyama et al. | |
| 5,898,446 | A | 4/1999 | Moriyama | |
| 6,097,408 | A * | 8/2000 | Fukushima et al. | 347/34 |
| 6,935,737 | B2 | 8/2005 | Kanome et al. | |

FOREIGN PATENT DOCUMENTS

| | | |
|---|---|---|
| JP | 5-124187 | 5/1993 |
| JP | 11245390 A * | 9/1999 |

* cited by examiner

*Primary Examiner* — Omar Rojas
(74) *Attorney, Agent, or Firm* — Fitzpatrick, Cella, Harper & Scinto

(57) ABSTRACT

To achieve high-quality printing by controlling an ink-travelling direction by an electrostatic force so that the ink can be accurately applied on a printing medium, the ink is landed on a desired position of the printing medium effectively without disturbing the ink ejection, independent of a difference in the thickness of the printing medium. An electric field between a printing head and the printing medium is generated by applying a voltage to a platen of conductive material positioned immediately below the printing medium. At this point, the voltage applied to the platen is adjusted so that the electric field of a preferable intensity can be generated on a face of the printing head where ejection openings are formed irrespective of the thickness of the printing medium.

6 Claims, 7 Drawing Sheets

INKJET PRINTING APPARATUS

BACKGROUND OF THE INVENTION

1. Field of the Invention

The present invention relates to an inkjet printing apparatus.

2. Description of the Related Art

Along with a recent wide spread of OA (office automation) equipment such as a personal computer and a word processor, various printing apparatuses are available for printing information output from such equipment on various printing media. Particularly, an inkjet printing apparatus has the advantages of causing less noise, running at a low cost, and having a compact size and structure relatively easily made to support color printing. For this reason, the inkjet printing apparatus is accepted by users for a wide variety of purposes.

Additionally, the volume per ink droplet used in an inkjet printing apparatus is made as fine as several pl (picoliters) or less so as to meet the recent requirement for higher definition printing. Furthermore, there has appeared an apparatus with a printing head which ejects ink droplets of 1.0 pl or less.

The volume of such a fine ink droplet is equal to that of a mist particle, so that it is difficult to control each ink droplet individually. To put it another way, from view point of higher definition printing, it is preferable to apply ink droplets of, for example, 1.0 pl or less to desired positions on a printing medium with accuracy of μm order; however, it is difficult to achieve a desired accuracy because ink droplets thus ejected are influenced by the surrounding air flow.

This phenomenon is particularly a problem in printing at a higher speed. There is an example of an inkjet printing apparatus having an inkjet printing head (hereinafter, also simply referred to as a printing head) with arranged ejection openings. The inkjet printing apparatus performs printing on a printing medium, while moving the inkjet printing head in main scanning directions which are different from a direction of the ejection-opening arrangement. The main scanning of the printing head and the conveyance of the printing medium (sub scanning) are alternately repeated to perform printing. In such a configuration, it is necessary to move the printing head in the main scanning directions at a high speed in order to increase the printing speed. This printing head movement moves the air so strongly as to disturb the flying of the ejected ink droplets.

Moreover, the single ink droplet is divided into several droplets immediately after the ejection, and thus much finer ink droplets called satellites are formed. These finer ink droplets may either be applied to unintended positions, or may stay floating inside the space of the printing apparatus. Moreover, when ink droplets land on a printing medium, finer ink droplets bounce back from the surface of the printing medium. Such finer ink droplets and satellites (hereinafter, these are referred to as ink mists) stay floating in the air, and eventually are adhered to and accumulated inside the apparatus, resulting in various problems. Specifically, for example, the ink mists make the inside of the printing apparatus unclean, deteriorate proper operations of a movable portion of the printing apparatus by adhering thereto, cause various sensors to malfunction, and also adheres to the surface of a printing medium to make it unclean.

In order to deal with such problems, a method to control ink droplets has been proposed (for example, in Japanese Patent Laid-open No. 5-124187 (1993)) as follows. Specifically, an electric field is generated between a printing head and a printing medium, so that ejected ink droplets are attracted to the printing medium by an electrostatic force. Thereby, the ink droplets are applied to desired positions on the printing medium.

In the meanwhile, inkjet printing apparatuses are extensively used by users in a wide variety of fields, and the purposes of the printing also vary. Accordingly, the users select a variety of conditions (printing conditions). Such printing conditions include, for example, the type of printing medium, print quality, and the like. Specifically, the users sometimes select, as a printing medium, a so-called plain paper as well as glossy paper, matte paper, art paper, synthetic paper, cloth, and the like. Moreover, the users may seek high-definition printing, i.e. high-quality printing, or may seek high-speed printing in which a printing speed has priority over a printing quality.

Under such circumstances, the present inventors have found that a simple application of a technique, as described in Japanese Patent Laid-Open No. 5-124187 (1993), may result in inappropriate printing. This application result will be described below.

In order to perform margin-less printing with an electric field generated between a printing head and a printing medium, the following configuration is given. A platen, which supports the printing medium, formed of a conductive material is disposed to a position facing a surface (ejection face) of the printing head provided with ejection openings. By applying a high positive voltage to the platen, the surface (surface supporting the printing medium) is positively charged. Accordingly, polarization occurs in the printing medium being in contact with the platen 107. The supported surface (bottom surface) of the printing medium is negatively charged, while the opposite surface (top surface) facing to the printing head is positively charged. At this point, when ink droplets are ejected to the printing medium from the printing head having an electric potential of zero, the ink droplets travel to and land on the printing medium. Although the liquid ink droplets ejected from the printing head originally have a momentum in the ejection direction, the ink droplets travel toward the printing medium at an accelerated rate while being attracted to the positively charged top surface of the printing medium.

However, the material and thickness of the printing medium differ depending on its type. Accordingly, on the top surface of the printing medium which has a high permittivity from the bottom surface to the top surface thereof and which loses less electricity inside thereof, the voltage applied to the platen tends to appear without loss in its magnitude. In contrast, in a case of a printing medium having a low permittivity and more internal electric loss, the voltage applied to the platen tends to be reduced. Thus, the effect of generation the electric field between the printing head and the printing medium may not be sufficiently achieved.

SUMMARY OF THE INVENTION

The present invention has been made in taking the above described problems into consideration, and has an object to appropriately control an electric field generated between a printing head and a top surface of a printing medium.

In a first aspect of the present invention, there is provided an inkjet printing apparatus for printing with a printing head which ejects ink to a printing medium, the apparatus comprising:

a conductive member disposed in a region which faces the printing head;

a voltage applier which applies a voltage to the conductive member for generating an electric field between the printing head and the conductive member; and a controller that causes the printing head to eject the ink onto the printing medium conveyed between the printing head and the first conductive member, the electric field being generated therebetween by the voltage applier;

wherein the voltage applied to the conductive member by the voltage applier when a first printing medium is used differs from the voltage applied to the conductive member by the voltage applier when a second printing medium thicker than the first printing medium is used.

In a second aspect of the present invention, there is provided an inkjet printing apparatus for printing with a printing head which ejects ink to a printing medium, the apparatus comprising:

a conductive member disposed in a region which faces the printing head;

a voltage applier which applies a voltage to the conductive member for generating an electric field between the printing head and the conductive member; and a controller that causes the printing head to eject the ink onto the printing medium conveyed between the printing head and the first conductive member, the electric field being generated therebetween by the voltage applier;

wherein the voltage applier controls the voltage applied to the conductive member in accordance with thicknesses of the printing medium.

In a third aspect of the present invention, there is provided an inkjet printing apparatus for printing with a printing head which ejects ink to a printing medium, the apparatus comprising:

a conductive member disposed in a region which faces the printing head; and an electric field generator for generating an electric field between the printing head and the conductive member;

wherein the electric field generator performs a control to generate or not to generate the electric field in accordance with a type of the printing medium.

In a fourth aspect of the present invention, there is provided an inkjet printing apparatus for printing with a printing head which ejects ink to a printing medium, the apparatus comprising:

a conductive member disposed in a region which faces the printing head; and a voltage applier which applies a voltage to the conductive member for generating an electric field between the printing head and the conductive member;

wherein the voltage applier controls the voltage applied to the conductive member in accordance with a print mode.

In a fifth aspect of the present invention, there is provided an inkjet printing apparatus which performs printing on a printing medium by repeating a scanning of a printing head which ejects ink and a conveying of the printing medium alternately, the apparatus comprising:

a conductive member disposed in a region which faces the printing head; and a voltage applier which applies a voltage to the conductive member for generating an electric field between the printing head and the conductive member during the scanning of the printing head;

wherein the voltage applier reduces a level or duty of the voltage applied to the conductive member during the conveying of the printing medium to be lower than a level or duty of the voltage applied to the conductive member during the scanning of the printing head, or applies no voltage during the conveying of the printing medium.

According to the present invention, it is possible to generate an electric field of a desired intensity between the printing head and a top surface of the printing medium by controlling a voltage applied to the conductive member. Thereby, it is possible to improve an effect (landing accuracy) of applying ink droplets to desired positions on the printing medium.

Further features of the present invention will become apparent from the following description of exemplary embodiments with reference to the attached drawings.

DESCRIPTION OF THE EMBODIMENTS

Hereinafter, the present invention will be described in detail with reference to the drawings.

It should be noted that, in this specification, "printing" refers not only to a case of forming significant information such as character and graphic. Specifically, "printing" widely refers to a case of forming image, design, pattern, and the like on a printing medium irrespective of significance or unmeaning, and also irrespective of whether the resultant of the printing is actualized or not so that a person can visually perceive it, or a case of processing a printing medium.

Moreover, a "printing medium" refers to not only paper generally used in a printing apparatus, but also a wide range of articles which can receive ink, such as fabric, plastic film, metallic plate, glass, ceramic, wood, leather.

Furthermore, "ink" should be construed widely similar to the definition of "printing". Specifically, "ink" refers to a liquid, upon provision onto a printing medium, which can be used in: forming such as image, design and pattern; processing a printing medium; or processing ink (for example, solidification or insolubilization of a coloring agent in ink provided to a printing medium).

1. First Embodiment

Configuration of Inkjet Printing Apparatus

Figure 1:
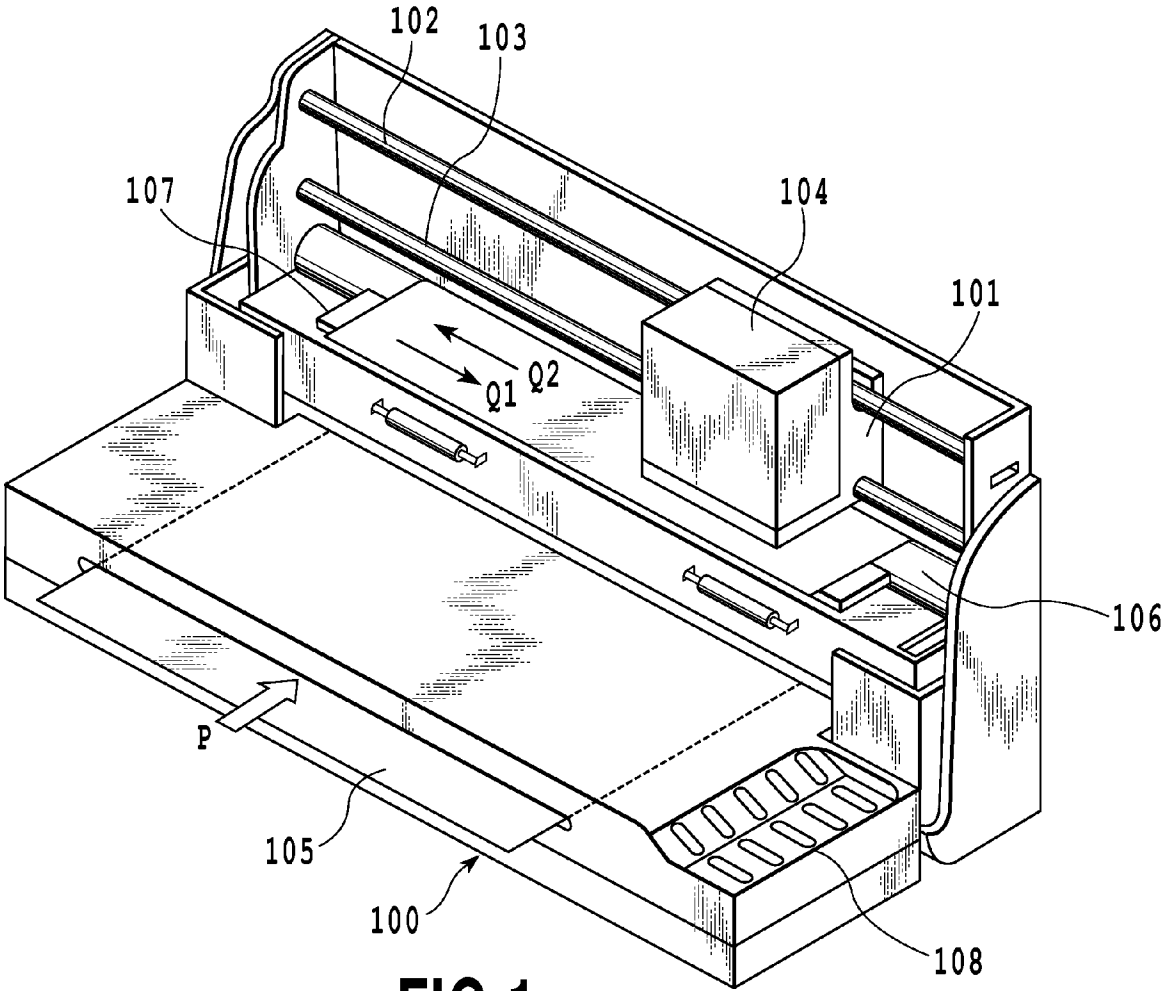
FIG. 1 is a perspective view showing a schematic configuration of an inkjet printing apparatus according to a first embodiment of the present invention.

FIG. 1 is a perspective view showing a schematic configuration of an inkjet printing apparatus (hereinafter, may be simply referred to as a printing apparatus) according to a first embodiment of the present invention.

As shown in FIG. 1, an inkjet printing head 104 is mounted on a carriage 101 which is capable of reciprocal movement in Q1 and Q2 directions (main scanning directions) with a driving force generated from a motor (unillustrated). Reference numerals 102 and 103 denote shafts which extend in the movement direction of the carriage, and which guide and support the carriage for its movement. A printing medium 105 is conveyed to a printing position which faces the ejection face of the printing head 104. At the printing position, ink is ejected from ejection openings of the printing head 104 downward in the drawing, and thereby printing is performed.

Figure 2:
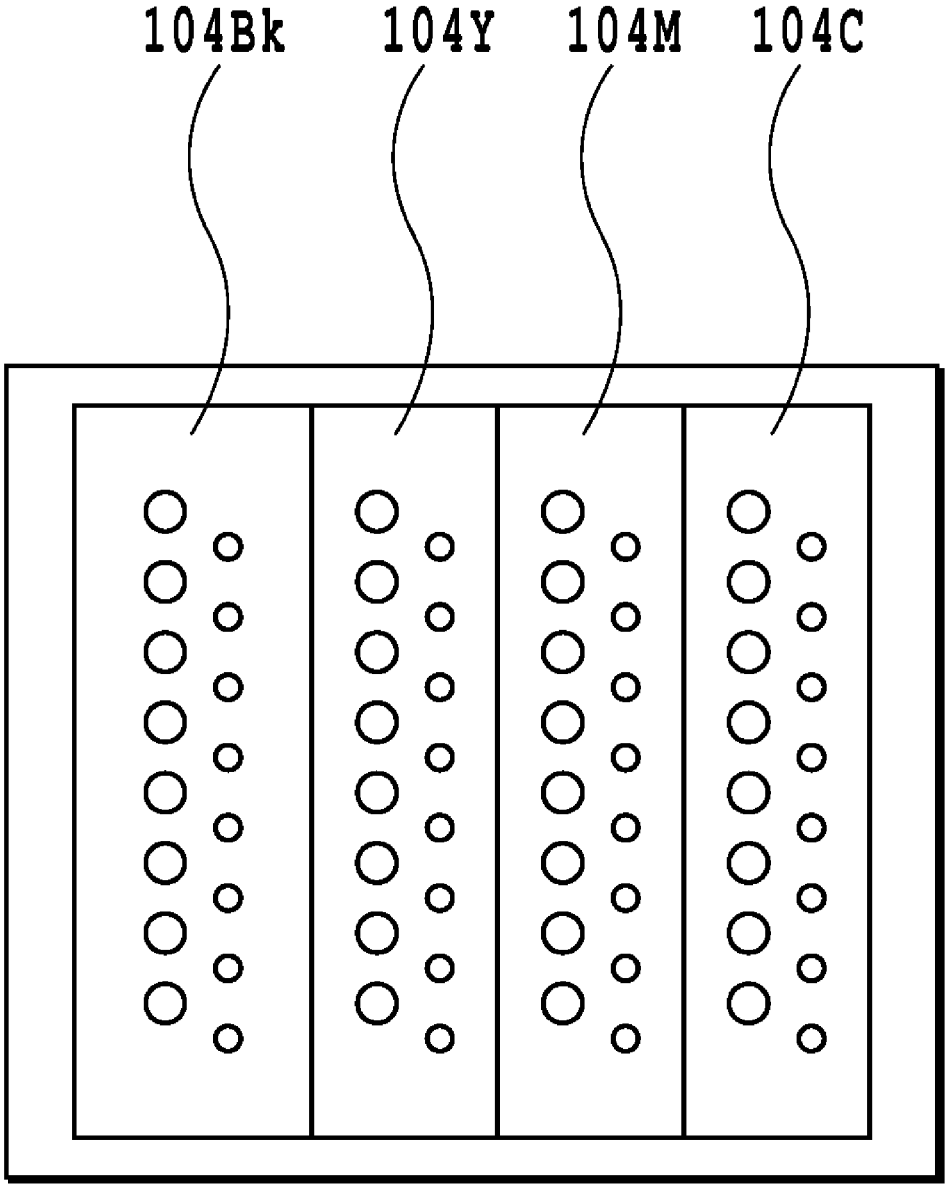
FIG. 2 shows a configuration example of an ejection face of a printing head which is used in the inkjet printing apparatus in FIG. 1.
Figure 3:
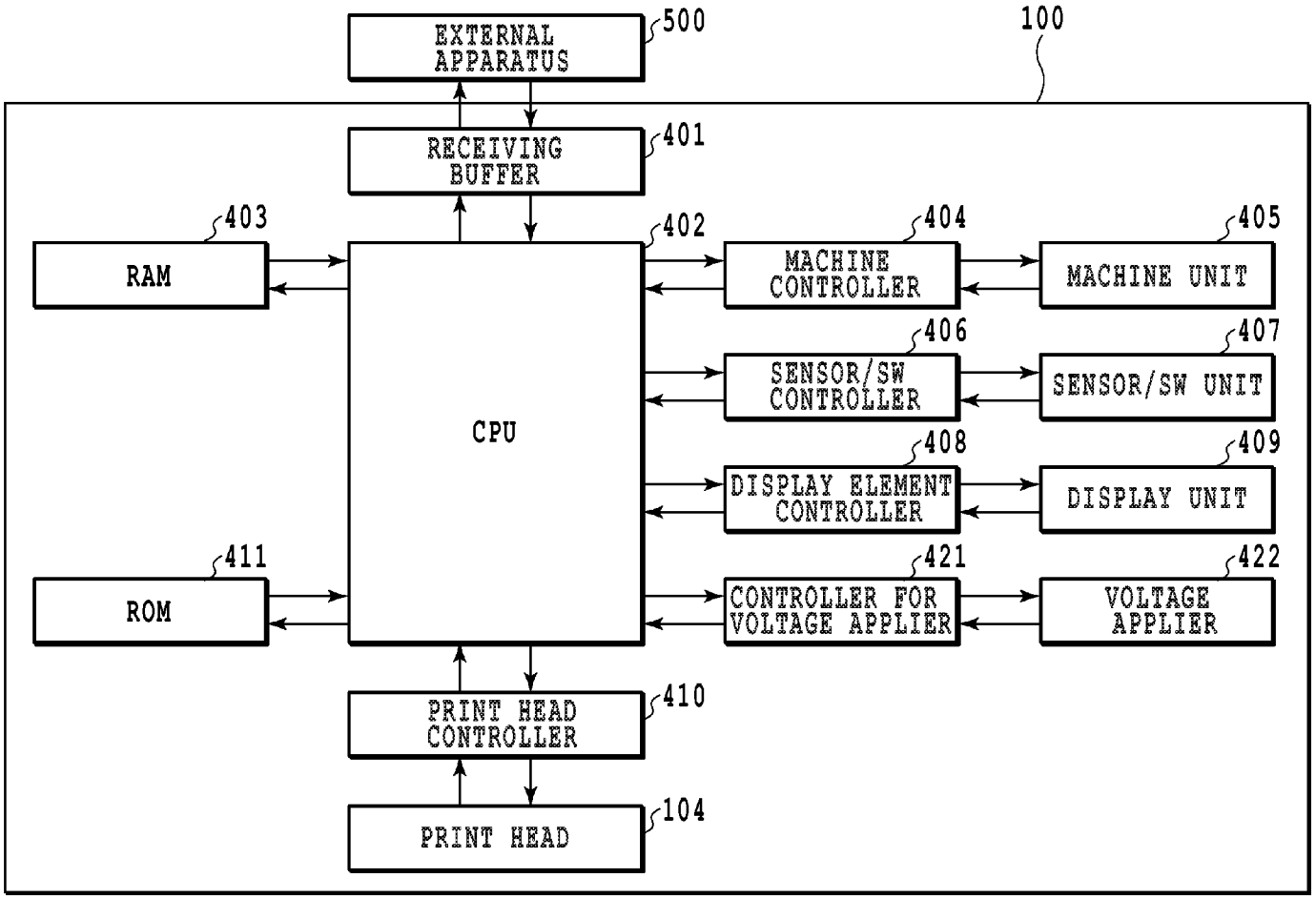
FIG. 3 is a block diagram showing a configuration example of a control system of the printing apparatus shown in FIG. 1.

FIG. 2 shows the ejection face of the printing head 104. The printing head 104 includes ejection portions 104M, 104C, 104Y, and 104Bk, which eject color inks of magenta (M), cyan (c), yellow (Y), and black (Bk), respectively. The printing apparatus shown in FIG. 1 is capable of color printing. In each ejection portion, for example, 128 ejection openings which eject 5 pl of ink, are arranged in a sub-scanning direction crossing the main scanning directions, at a pitch of 600 dpi. Similarly, different 128 ejection openings which eject 2 pl of ink, are arranged in the sub-scanning direction at a pitch of 600 dpi. The carriage 101 or the printing head 104 is provided with ink tanks (unillustrated) for containing and supplying the respective color inks to the ejection portions for the corresponding colors. Each of the ink tanks for the respective colors is in a form of cartridge, and is detachable independently.

The joining surfaces of both the carriage 101 and the printing head 104 are brought into contact with each other appropriately so that a predetermined electrical connection therebetween can be achieved and maintained. By applying an energy to ink according to a printing signal, the printing head 104 selectively ejects ink from the multiple ejection openings thereby to perform printing. More specifically, the printing head 104 of the present embodiment employs a method of ejecting ink with use of a thermal energy. To generate such a thermal energy, the printing head 104 is provided with an electrothermal transducing element. An electric energy applied to the electrothermal transducing element is converted into a thermal energy. This energy is subsequently applied to ink, causing the film boiling which generates bubbles therein, and further causing the bubbles to grow and contract. Accordingly, the ink is ejected from the ejection openings, utilizing a change in pressure accompanying the growth and contraction. The electrothermal transducing element is provided to each of the ejection openings. A pulse voltage is applied to the electrothermal transducing element in accordance with and corresponding to a printing signal, and thereby ink is ejected from the ejection openings corresponding to that signal.

A platen 107 is provided to a position facing to the ejection face of the printing head 104, and supports the printing medium 105. The platen 107 flattens the printed surface of the printing medium 105. The platen 107 is formed of a conductive material, and thus the platen 107 itself serves as a conductive member. To be described later, the platen 107 is connected to a voltage applier via a resistor of 10 MΩ. Incidentally, the platen may be formed of a non-conductive material while a member formed of a conductive material may be disposed on the platen at a portion being in contact with a reverse or bottom surface of a printing medium, to serve as the conductive member.

The printing medium 105 is conveyed in a direction (conveying direction) of an arrow P, the conveying direction crossing the main scanning direction. Here, when the printing operation is started, ink droplets ejected from the printing head 104 are attracted by the electric potential of an obverse or top surface of the printing medium, and the charged ink droplets go to the top surface of the printing medium. The electric potential of the printing head 104 is 0 V, and the electric potential in the vicinity of the ink ejection openings is also 0 V. Note that a mechanism to reduce the polarizing degree of the printing medium 105, can be disposed to a position downstream in a conveying direction of the printing medium 105, that is, a position where the printing medium 105 is discharged outside the printing apparatus by a discharge roller or the like, after the printing by the printing head 104.

Configuration of Control System of Inkjet Printing Apparatus

Figure 5:
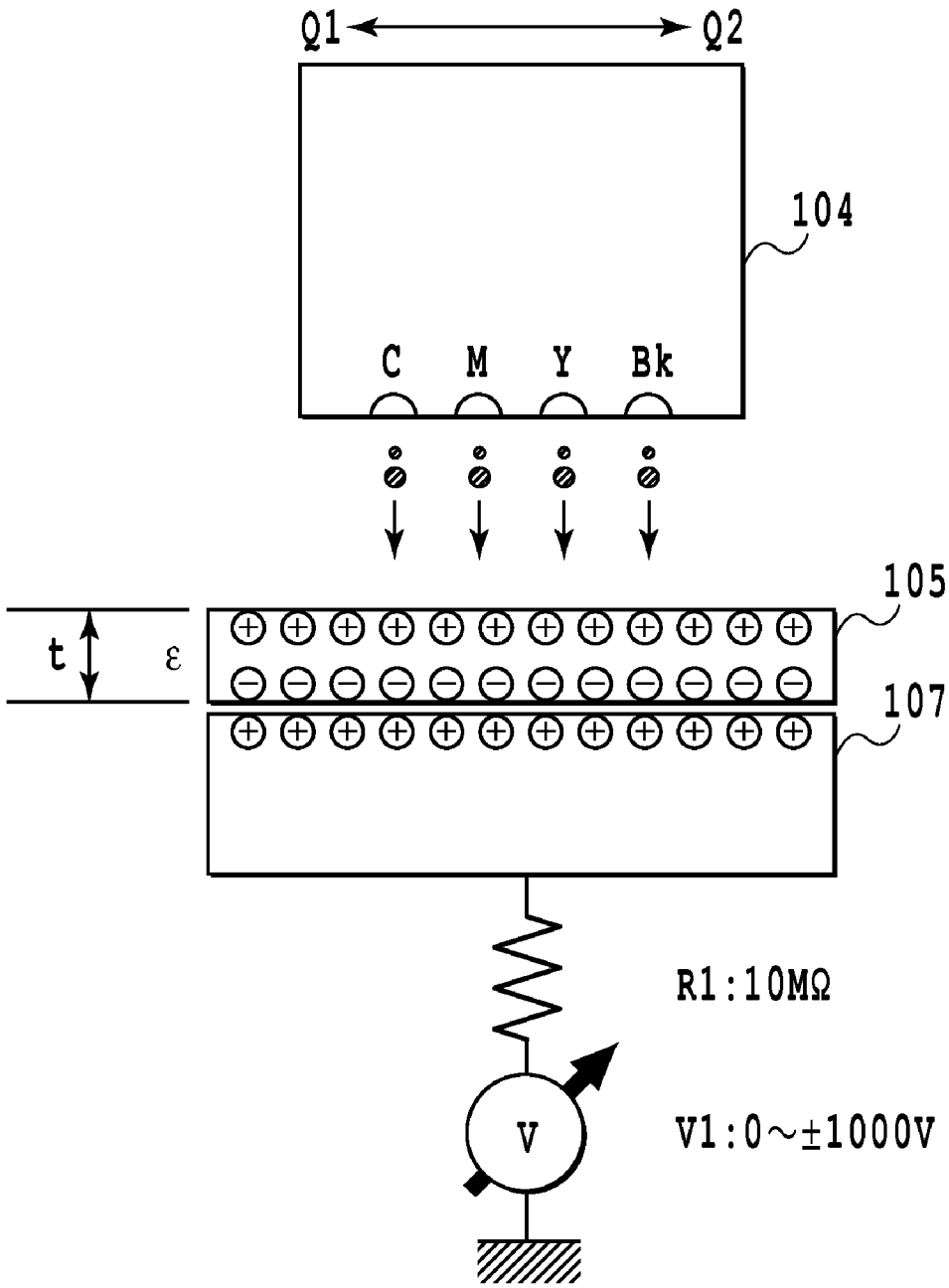
FIG. 5 is a schematic side view for explaining a specific operation when printing is performed according to the process procedure in FIG. 4.

FIG. 5 is a block diagram showing a configuration example of a control system of the printing apparatus shown in FIG. 1.

Image data on characters, images, or the like, to be printed is transmitted from an external apparatus 500 to the printing apparatus whole of which is denoted by reference numeral 100. The image data is saved in a receiving buffer 401 of the printing apparatus 100. Moreover, data to check whether or not image data is transferred correctly, and data to notify of an operation condition of the printing apparatus 100 are transmitted from the printing apparatus 100 to the external apparatus 500.

Here, the external apparatus 500 is a personal computer (PC) which serves as a host apparatus, a digital camera, or the like. Any type of apparatus may be used as the external apparatus 500 as long as it is capable of transmitting image data to the printing apparatus 100. The image data includes print image data to show an image to be printed and information on print control for controlling the printing. The information on print control includes "information on printing medium", "information on print quality", and the like. The information on printing medium describes information on, for example, type and size of printing medium to be printed. The type of printing medium is information on a plain paper, a glossy paper, a matte paper, and the like. The size of printing medium is, for example, A4, A3, and postcard size. Moreover, the information on print quality describes the quality of printing, and any one of quality descriptions among "fine (high-quality print)", "normal", "fast (high-speed print)", and the like, is specified. Note that these pieces of the information on print control are formed on the basis of what the user inputs through a user interface (UI) screen of a monitor when a PC is used as the external apparatus 500, for example.

Figure 6:
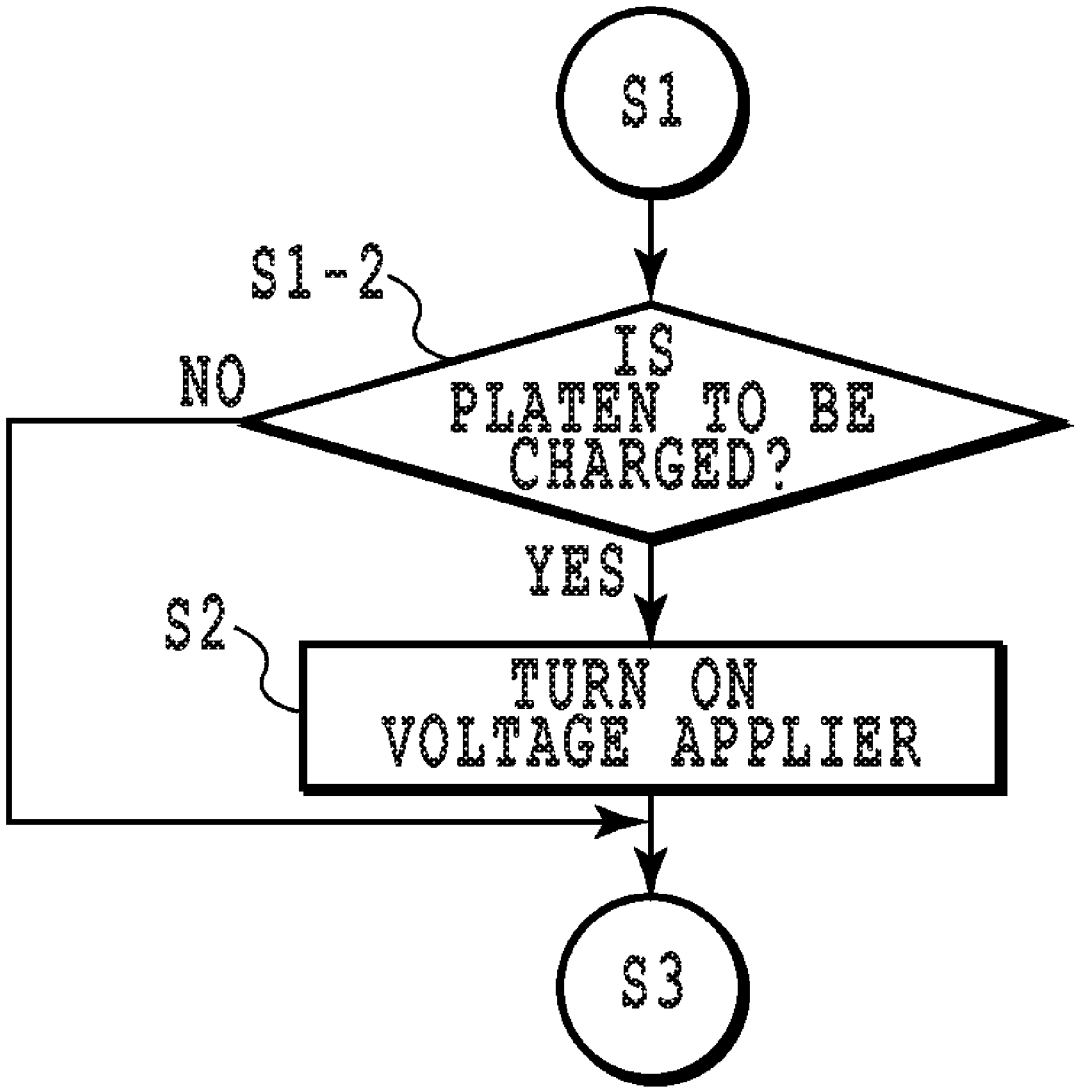
FIG. 6 is a flowchart showing principal parts of a printing process procedure according to another embodiment of the present invention.

A CPU 402 is a main control unit of the entire system, and controls each unit in accordance with a program corresponding to a process procedure or the like which will be described later with FIG. 6. A ROM 411 stores the program and other fixed data.

Under the control of the CPU 402, the image data saved in the receiving buffer 401 is processed into data which matches the configuration of the printing head 104, and which is stored in a print buffer in a random-access memory (RAM) unit 403. The data in the print buffer is forwarded to the printing head 104 by a printing head controller 410, and the printing head 104 is driven according to the data. Accordingly, each color ink is ejected to form an image on the printing medium 105. Meanwhile, the printing head controller 410 detects, for example, temperature information indicating a condition of the printing head 104, and transmits such information to the CPU 402. The information allows the CPU 402 to control the driving of the printing head 104 with the printing head controller 410.

A machine controller 404 controls the driving of a machine unit 405 according to a command from the CPU 402. The machine unit 405 has a configuration of the machine system described in FIG. 1, and the machine unit 405 specifically includes a motor for moving the carriage 101, a motor for conveying the printing medium 105, and so on. A sensor/switch (SW) controller 406 transmits a signal, from a sensor/SW unit 407, to the CPU 402, and controls the sensor/SW unit 407. The sensor/SW unit 407 consists of various sensors and switches provided to the printing apparatus 100. According to a command from the CPU 402, a display element controller 408 controls a display unit 409, and displays an operation condition of the apparatus to the user. The display unit 409 consists of display panels of LEDs or liquid-crystal display elements. The switches, display units, and the like are disposed on positions denoted by reference numeral 108 in FIG. 1.

A controller 421 controls a voltage applier 422 connected to the platen 107, and thereby a desired voltage is generated. This voltage can be adjusted within a range of ±1000 V, and also can be turned on or off. In other words, it is possible to control the voltage applied to the platen 107 serving as the conductive member. The voltage applier 422 functions as an electric-field generator.

Printing Process

Figure 4:
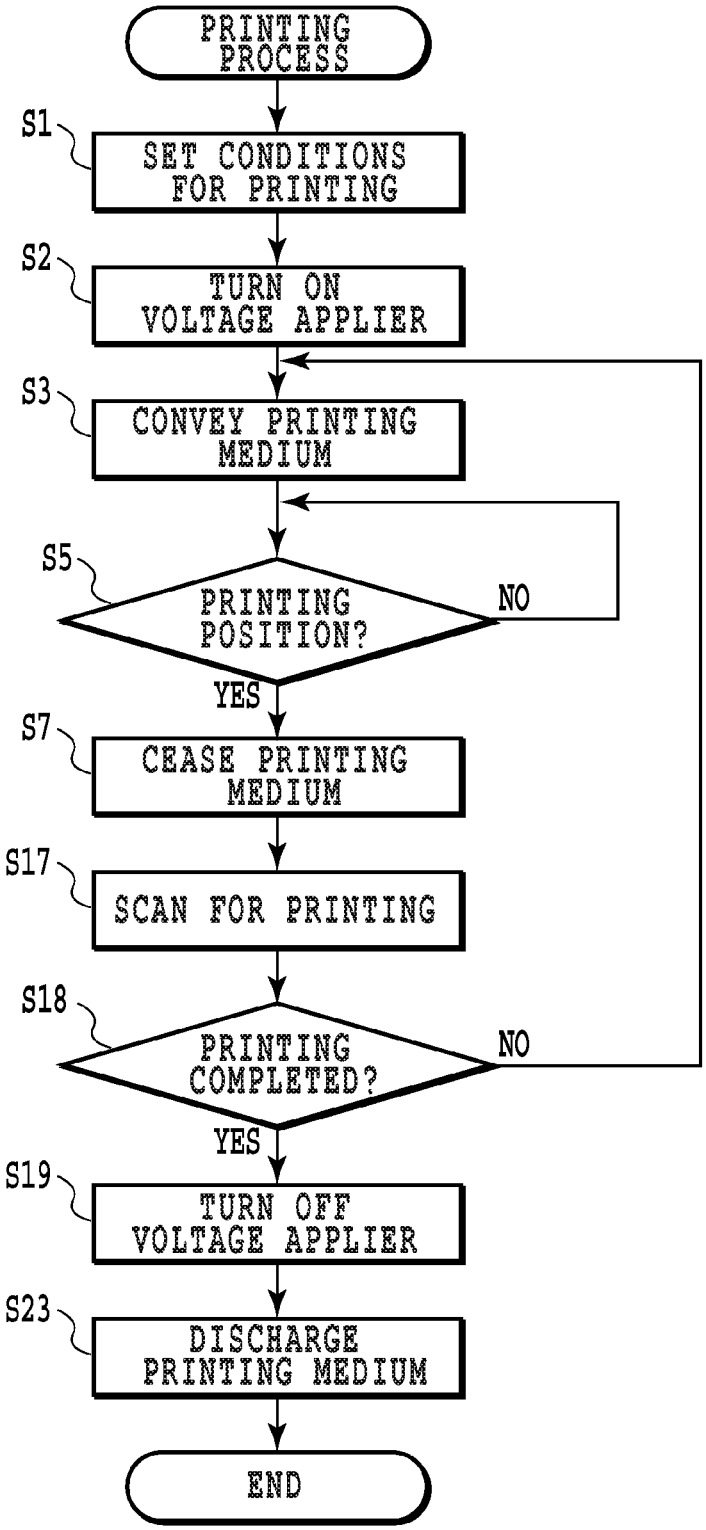
FIG. 4 is a flowchart showing an example of a printing process procedure executed by the printing apparatus shown in FIG. 1.

FIG. 4 is a flowchart showing an example of a printing process procedure executed by the printing apparatus according to this embodiment.

Image data is transmitted from the external apparatus 500 which serves as the host apparatus, and printing is instructed. Then, information on print control, which is added to the image data, is recognized, and desired settings are performed (Step S1). In this embodiment, a printing condition to be set is particularly a voltage value corresponding to the thickness of a printing medium to be used.

Subsequently, the controller 421 controls the voltage applier 422, and the voltage thus set is applied to the platen 107 (Step S2). Thereafter, the printing medium 105 is fed and conveyed (Step S3). When the printing medium comes to a printing position (Step S5), the conveying of the printing medium is ceased at the position (Step S7). At this position, the printing head 104 is main-scanned to perform printing for the amount of single scanning.

After that, whether all the printing operations on the printing medium 105 are completed or not is determined (Step S18). If not completed, the processing is returned to Step S3, and the above-described steps are repeated. On the other hand, when all the printing operations are completed, the voltage applier 422 is turned off (Step S19), the printing medium 105 is discharged (Step S23), and this procedure ends.

FIG. 5 is a schematic side view for explaining a specific operation when printing is performed according to the above process procedure.

Here, an explanation will be made in a case that 5 pl of ink is ejected from the printing head 104. Moreover, a sheet of glossy paper which is mainly designed for photo printing is used as the printing medium. The printing medium has a thickness, t, of approximately 0.26 mm. Electricity does not pass from the bottom surface (which is supported by the platen 107) to the top surface (printed surface) of the printing medium, i.e. the electric-conductive property is non-conductive. For this reason, when the voltage applier 422 is turned on, the application of, for example, +700 V of voltage from the platen 107 to the bottom surface should give the top surface almost the same electric potential, also. However, the potential of the top surface is actually somewhat lower than that of the platen 107, and is approximately +650 V.

When ink droplets are ejected toward the printing medium from the printing head 104 having an electric potential of zero, the ink droplets travel to and reach the printing medium 105. The liquid ink droplets ejected from the printing head 104 originally have a momentum in the ejection direction (downward direction in the drawing), and the movement of the ink droplets is accelerated due to the attraction to the top surface of the printing medium, which has an electric potential of approximately +650 V.

If the electric potential of the top surface of the printing medium which is in turn the electric field on the ejection face of the printing head is too low, an effect is achieved only to a lesser extent. Meanwhile, if the electric potential or the electric field is too high, the ink ejection is observed to be disturbed. Thus, these conditions are not preferable. This suggests that the electric potential of the top surface of the printing medium as well as an intensity of the electric field on the ejection face of the printing head need to be set within preferable ranges in relation to the distance to the top surface of the printing medium. In the printing apparatus of this embodiment, the distance between the ejection face of the printing head and the top surface of the printing medium of the above-described type and thickness, is set 1.0 mm. In this configuration, an intensity of the electric field, E1, is:

$$E1=650\ [V]/1.0\ [mm]=650\ [V/mm].$$

It is found that, when an electric field of approximately 650 V/mm is generated, the ejection of the ink droplets is not disturbed, and the traveling direction thereof is effectively controlled by an electrostatic force. In other words, the shifting of the ink-landing positions can be reduced, in contrast to a case where the electric field is not generated. Moreover, the electric field acts to reduce the amount of ink mists.

In the above system, when a printing medium of the same type (i.e., having the same relative permittivity) and having the thickness t of 0.52 mm which is twice as thick as that in the above case, the potential of the top surface of the printing medium is approximately 550 V. An intensity of the electric field at this time, E2, is:

$$E2=550\ [V]/(1.0-0.26)\ [mm]=743\ [V/mm].$$

Here, a clearance between the ejection face of the printing head and the platen 107 is made to be unvaried, and the distance between the ejection face of the printing head and the top surface of the printing medium is 0.74 mm. Meanwhile, in the inkjet printing apparatus for printing media of various thicknesses, a mechanism is adopted to maintain the distance (1.0 mm) between the ejection face of the printing head and the top surface of the printing medium, while a distance of the clearance is made to be varied so that the ejection face may not come into contact with the printing medium. In this case, an intensity of the electric field, E3, is:

$$E3=550\ [V]/1.0\ [mm]=550\ [V/mm].$$

In this respect, when E1 is compared with E3, E3 is apparently smaller. Accordingly, it is found that there is a small effect of attracting the ink droplets to the top surface of the printing medium in that condition. On the other hand, when the voltage applied to the platen 107 is increased to 900 V and the intensity of the electric field is caused to be approximately 750 V/mm, deterioration in printing is observed, which seems to be caused by the disturbance in the ink ejection. The same holds true for a case where the distance between the ejection face of the printing head and the platen 107 is made to be unvaried and where the distance between the ejection face of the printing head and the top surface of the printing medium is 0.74 mm, as well.

As a result, found are described as follows. When the distance between the ejection face of the printing head and the platen (i.e., the bottom surface of the printing medium) is maintained, the electric field on the ejection face is increased as the thickness of the printing medium is increased. In the meanwhile, when the distance between the ejection face and the top surface of the printing medium is maintained, the electric field on the ejection face is decreased, as the thickness is decreased. Accordingly, a level of the voltage applied to the platen 107 should be determined in accordance with the thickness of the printing medium and the distance between the top surface of the printing medium and the ejection face of the printing head, and should be set within a range so that an electric field of a desired intensity can act on the ejection face, if the materials of the printing media are the same. For example, in a case where the distance between the ejection face and the top surface of a printing medium is set 1 mm, the printing medium having a thickness (0.52 mm) which is twice the above-described thickness of 0.26 mm, a preferable result is obtained by applying a voltage of 800 V to the platen 107.

The setting of voltage corresponding to the thickness of the printing medium in the above-described manner, can be performed on the basis of information on printing medium, which is included in the information on print control. For instance, the type (thickness) of printing medium and the voltage value corresponding to this information may be tabulated in advance, and stored in the ROM 411. Then, this table is referred to in Step S1 of FIG. 4 to perform the voltage setting.

In this embodiment, the voltage to be applied is set according to the thickness of the printing medium as described above. In this manner, the intensity of the electric field generated between the printing head and the platen (conductive member) can be suppressed to be within a predetermined range so as to correspond to any thickness of the printing medium.

Specifically, independent of the thickness of the printing medium, the distance between the head and the platen is adjusted to maintain the distance between the top surface of the printing medium and the ejection face of the printing head. Furthermore, as the thickness of the printing medium increases, the voltage to be applied is set higher. For example, suppose a case where a first printing medium (thickness: 0.26 mm) and a second printing medium (thickness: 0.52 mm) which is thicker than the first printing medium are usable. In this case, the distance between the top surface of the printing medium and the ejection face of the printing head is adjusted to be approximately the same (for example, about 1 mm) for both cases of using the two kinds of media. The voltage (800 V) applied when the second printing medium is used is set higher than the voltage (700 V) applied when the first printing medium is used. Thereby, it is possible to set a voltage that appropriately corresponds to the thickness of the printing medium. Thus, independent of the thickness of the printing medium, the shifting of ink-landing position is suppressed. In other words, the shift of the ink-landing position of the ink ejected under the electric field generated is made smaller than the shift thereof under no electric field generated.

As has been described, according to this embodiment, it is possible to improve landing accuracy of ink by adopting the basic configuration to control the travelling direction of ink droplets by an electrostatic force. Furthermore, the amount of ink mists is reduced, and hence the problems due to the ink mists are suppressed,

Modification Example of First Embodiment

In the above-described embodiment, the distance between the top surface of the printing medium and the ejection face of the printing head is adjusted, and the voltage applied when a thicker printing medium is used is set higher than that applied when a thinner printing medium is used. However, the method to suppress the intensity of electric field generated between the printing head and the platen (conductive member) within a predetermined range independent of the thickness of the printing medium is not limited to the method in the above example.

In this modification example, even when printing media having different thicknesses are used, the distance between the head and the platen is not changed, but only the applied voltage is adjusted. In other words, the voltage applied when a thicker printing medium is used is set lower than the voltage applied when a thinner printing medium is used.

As described above, in a case where: the applied voltage is set to 700 V; the distance between the ejection face of the printing head and the platen (head-to-platen distance) is set to 1 mm; and the printing medium having a thickness of 0.26 mm is used, the intensity of the electric field E1 is 650 [V/mm]. When the intensity of the electric field is approximately 650 [V/mm], the ink ejection is not disturbed. Thus, the travelling direction of ink droplets is effectively controlled, and thereby the amount of ink mists can be reduced. In the meanwhile, in a case where the conditions of the applied voltage (700 V) and the head-to-platen distance (1 mm) are the same, but where the printing medium has a thickness of 0.52 mm, the intensity of the electric field E2 is 743 [V/mm]. As described above, when the intensity of the electric field is approximately 750 V/mm, the ink ejection is disturbed. To avoid this, the intensity of the electric field should be reduced. For this reason, when the printing medium having a thickness of 0.52 mm is used, the level of the voltage is set lower than 700 V so that the intensity of the electric field can be reduced to approximately 650 V/mm. Thereby, it is possible to desirably control, independent of the thickness of the printing medium, the intensity of the electric field generated between the head and the platen without changing the head-to-platen distance.

Various Embodiments

Second Embodiment

In the first embodiment, exemplified is the appropriate voltage setting which is performed in accordance with the thicknesses of the printing media of the same type. However, if a printing medium is formed of a material different from that used in the above embodiment, the application of the same voltage to the platen may give the top surface of the printing medium a different electric potential from that in the above embodiment. This is because, if a printing medium has a high permittivity from the bottom surface to the top surface thereof and loses less electricity inside thereof, the top surface of the printing medium tends to have the same electric potential as that applied to the platen. In contrast, in a case of a printing medium having a low permittivity and more internal electric loss, the electric potential tends to be reduced.

For this reason, in a second embodiment of the present invention, an electric field of a preferable intensity is generated by setting an appropriate voltage to the platen corresponding to the type (material) of printing medium used for printing, on the basis of the relationship between the electric potential of the platen and that of the top surface of the printing media formed of various materials.

These setting of voltage corresponding to the materials of these printing media can be performed on the basis of information on printing medium, which is included in the information on print control. For example, the type (material) of printing medium and the voltage value corresponding thereto may be tabulated in advance, and stored in the ROM 411. Then, this table is referred to in Step S1 of FIG. 4 to perform the voltage setting.

Third Embodiment

In the first embodiment, described is the case where 5 pl of ink droplets are ejected from the printing head 104 in the configuration shown in FIG. 2. The printing head 104 also has the ejection openings each of which ejects 2 pl of ink. The printing apparatus includes the multiple print modes as described above. When the high-quality print mode is selected, the printing operation can be performed by ejecting 2 pl of ink droplets.

In a third embodiment of the present invention, a voltage applied to the platen is set in accordance with the size of ink droplets.

Generally, if ink droplets are charged in the same levels, the smaller ink droplet is lower in mass, and conversely the accelerating force is increased. Thus, ejection from the printing head is only required for the smaller ink droplet to be adhered on a positively charged printing medium. In other words, the influence exerted from the electric field on the 2 pl of ink droplets is greater than that on the 5 pl of ink droplets. For this reason, in a case where relatively small ink droplets of 2 pl are ejected, it suffices to generate somewhat weaker electric field than that in a case of ejecting 5 pl of ink droplets. Therefore, a higher voltage is applied to the platen in a print mode in which a large amount of ink is ejected, while a lower voltage is applied in a print mode in which a smaller amount of ink is ejected.

To be more specific, in a case where the distance between the ejection face and the top surface of a printing medium having a thickness of 0.26 mm is set 1 mm, 700V is applied to the platen in a print mode for ejecting 5 pl of ink, while 650 V is applied to the platen in a print mode for ejecting 2 pl of ink. In this case, it has been confirmed that, even in the print mode for ejecting 2 pl of ink, the same effect is obtained as that in the aforementioned case of ejecting 5 pl of ink droplets.

In this embodiment, in addition to the above-described two print modes, it is possible to further design a print mode for printing by ejecting 2 pl and 5 pl of inks in combination. In this print mode, the voltage to be applied is set to 675 V which is in the middle of 700 V and 650 V.

The setting of voltage corresponding to the large/small amount of ejection can be performed on the basis of information on print quality, which is included in the information on print control. For example, the amount of ink ejected according to the information on print quality and the voltage value corresponding to this information may be tabulated in advance, and stored in the ROM 411. Then, this table is referred to in Step S1 of FIG. 4 to perform the voltage setting.

Fourth Embodiment

The printing apparatus in the first embodiment has the multiple print modes as described above, and is capable of setting at least a high-quality print mode and a high-speed print mode whose printing speed is faster than that in the high-quality print mode. This high-speed print mode is selected when a printing speed has a priority over an image quality. Meanwhile, the high-quality print mode is selected when an image quality has a priority over a printing speed.

In a fourth embodiment, power consumption is reduced in the high-speed print mode by reducing a voltage applied to the platen 107 in comparison with that in the high-quality print mode, or by not applying a voltage to the platen (turning off the voltage applier). For example, when the voltage applier is to be turned off, it is preferable to add a process step (Step S1-2) as shown in FIG. 6 between Steps S1 and S2 in the process procedure of FIG. 4. In Step S1-2 of FIG. 6, whether the platen 107 needs to be positively charged or not is determined after the recognition of the information on print control (Step S1 of FIG. 4). When the high-speed print mode is recognized, the processing immediately proceeds to Step S3, skipping Step S2 of FIG. 4. Meanwhile, when the high-quality print mode is selected, the processing proceeds to Step S2, and a voltage higher than that in the high-speed print mode is applied. Thereby, an electric field is generated between the printing head and the platen, and ink is ejected from the printing head in this condition. As a result, printing with high landing accuracy is performed.

Fifth Embodiment

The printing apparatus described in the first embodiment is capable of printing on various types of printing media as described above. At this point, when the user wants high-quality printing for carrying out photo printing, a dedicated printing medium such as glossy paper is selected. When printing other than high-quality printing is carried out, plain paper is often selected.

For this reason, in a fifth embodiment, when a dedicated printing medium such as glossy paper is selected, printing is performed after an electric field is generated between the platen and the printing head; and, when plain paper is selected, printing is performed without generating the electric field. More specifically, when the plain paper is selected, a voltage applied to the platen 107 is reduced, or no voltage is applied to the platen (the voltage applier is turned off). In this case, for example, the same procedure mentioned in the fourth embodiment is adopted. When the selection to the plain paper is recognized, the platen is not required to be charged, and thus Step S2 of FIG. 4 is skipped. In printing on the plain paper, the ink permeated into the printing medium may reach the platen, reducing the electric potential of the top surface of the printing medium in some cases. In other words, when the plain paper is used, the effect of applying a voltage to the platen is small in the first place, or the user may not have intended high-quality printing. Therefore, the processing of this embodiment is effective.

Sixth Embodiment

In the above-described embodiments, the controlling of a voltage applied to the platen and the determination on whether to apply the voltage are basically performed on the basis of the information on printing medium and the information on print quality which are included in the information on print control notified from the external apparatus according to a selection by the user. Meanwhile, such processes can be performed according to operation conditions of the printing apparatus, or the like.

The printing apparatus described above perform printing by repeating the main scanning of the printing head and the conveying of the printing medium alternately. In other words, the platen is not required to be positively charged during the conveying of the printing medium before and after the main scanning, because the ejection operation is not performed during the conveying of the printing medium.

Thus, in a sixth embodiment according to the present invention, during the conveying of the printing medium, a voltage applied to the platen 107 is reduced, or no voltage is applied to the platen (the voltage applier is turned off). For example, in the case where the voltage applier is turned off during the conveying of the printing medium, it is preferable to put the process Step S2 for turning on the voltage applier and the process Step S19 for turning off the voltage applier on immediately before and on immediately after the scanning for printing (Step S17), respectively, in the process procedure of FIG. 4.

According to this embodiment, it is possible to reduce power consumption, by turning on the voltage applier only at the required time. Moreover, this embodiment makes it possible to reduce the friction force between the printing medium and the platen at the time of conveying the printing medium, and thereby high-speed and accurate conveying is achieved.

In this way, the controlling of a voltage applied to the platen and the determination on whether to apply the voltage can be performed basically not only on the basis of the selection made by the user, but also on the basis of the operation conditions of the printing apparatus, or the like. Furthermore, the controlling of a voltage to be applied may be performed according to, if any, the change due to environmental conditions (such as humidity) during the printing operation in the electric potential of the top surface of the printing medium which is in turn the change in the intensity of the electric field.

Seventh Embodiment

In the above-described embodiments, exemplified is the case where a voltage is applied to the platen. In the meanwhile, in a seventh embodiment of the present invention, the effect is further improved by providing in the printing apparatus with a unit for generating ions of an opposite polarity to that of the charged platen or recorded surface of the printing medium.

Figure 7:
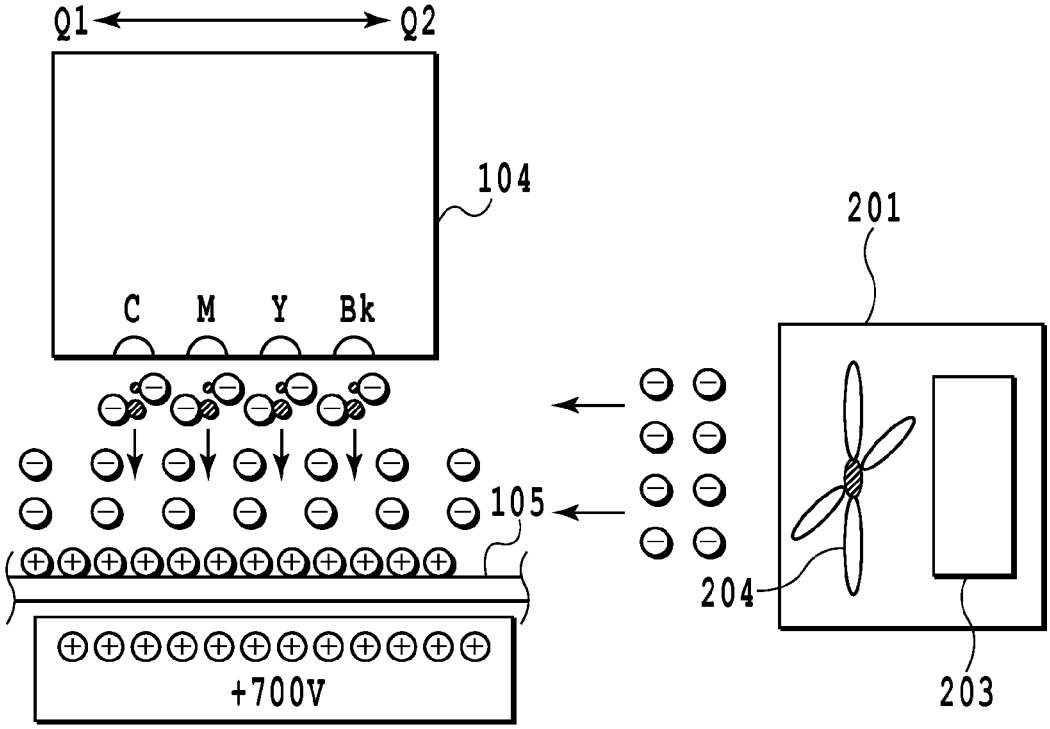
FIG. 7 is a flowchart showing principal parts of a printing process procedure according to a further embodiment of the present invention.

FIG. 7 is a schematic side view for explaining such a configuration example and operation. Here, reference numeral 201 denotes an ion-emitting unit for emitting any one of positive and negative ions. In this embodiment, a larger amount of negative ions are emitted, corresponding to the positively charged platen 107. The ion-emitting unit 201 includes an ion-generating portion 203 and a fan 204, the ion-generating portion 203 for generating negative ions.

Technically, the ion-generating portion 203 generates both positive and negative ions. However, when the ratio of one polarity of ions emitted from the emitting unit is higher than that of the other polarity of ions, it is considered that the ions of the one polarity are emitted. In this respect, when approximately 70% or more of generated ions are negative ions, the ion-generating portion 203 can be considered as a negative-ion-generating portion. The amount of generated ions can be measured with an ion counter or the like.

In this embodiment, the negative ions thus generated are transferred with air in the direction toward the printing head 104. Ions of the same polarity have a property such that the ions diffuse when densely floating in a small space in air. Accordingly, the distribution of the negative ions in the printing apparatus will be uniform even when the negative ions are left in the apparatus as emitted. However, in this embodiment, the small-size fan 204 is provided in order to increase the rate of ion-diffusion to the ink ejected area or the printing area. In other words, the negative ions generated at the ion-generating portion 203 are effectively diffused by a weak steady flow occurring from the fan 204 in the leftward direction in FIG. 7. In this manner, the negative ions are dominantly distributed (filled) in the space between the printing head 104 and the printing medium 105 placed on the platen 107.

Others

In the first to sixth embodiments, the controlling of a voltage applied to the platen and the determination on whether to apply the voltage are performed according to printing conditions such as the thickness and material of printing medium, the amount of ejected ink, printing quality, and the operation conditions of the printing apparatus, or the environmental conditions. In addition, in the seventh embodiment, described is the additional configuration to increase the effect of the basic configuration which controls the travelling direction of the ink droplets by an electrostatic force. Nevertheless, the present invention is not limited to these embodiments. It is needless to say that the embodiments of two or more can be combined as appropriate. In other words, as long as a voltage applied to a conductive member, which is capable of charging the printed surface of a printing medium, is variably controlled according to printing conditions, such a configuration is included in the scope of the present invention.

Moreover, in the first to sixth embodiments, by changing the level of the voltage applied to the conductive member (platen), the adjustment is made for the electric potential of the top surface of the printing medium or the intensity of the electric field generated between the printing head and the conductive member. However, a method other than this may be employed to adjust the electric potential of the top surface of the printing medium and the intensity of the electric field generated between the printing head and the conductive member. One employable method is a method to change a duty of the applied voltage. For example, in order to reduce the electric potential of the top surface of the printing medium and the intensity of the electric field generated between the printing head and the conductive member, it is possible either to reduce the applied voltage, or to reduce the duty of the applied voltage without changing the voltage to be applied.

Moreover, the number and type of color tone used in printing are not limited to those in the above description. In the above example, used are four color inks including black in addition to the so-called three primary colors for printing of cyan, magenta and yellow. However, it is possible to use color inks of only cyan, magenta and yellow, or only black ink. Alternatively, in place of or in addition to these inks, it is possible to use other color tones (taking color and density into consideration also). It goes without saying that, in terms of the configuration of the ejection portion for ejecting ink, it is not limited to the one shown in FIG. 2.

Furthermore, the printing head used in the above embodiments has the means to generate a thermal energy for ink ejection. However, it is also possible to use a printing head having other means such as a piezoelectric element.

In addition, in the above embodiments, description has been given of the case where the present invention is used in the inkjet printing apparatus of a so-called serial printer type. However, the present invention can be used in an inkjet printing apparatus of a so-called line printer type with a printing head having ejection openings aligned across an area which is corresponding to and is longer than the entire width of a printing medium.

Still furthermore, as the form of the printing apparatus of the present invention, it is possible to adopt a form of, for example, a copying machine in combination with a reader or the like, and a facsimile having receiving and transmitting functions, besides a form of a lower-level apparatus of information processing equipment such as a computer.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-126400, filed May 11, 2007, which is hereby incorporated by reference herein in its entirety.

What is claimed is:

1. An inkjet printing apparatus which ejects ink to a printing medium to perform printing on the printing medium, the apparatus comprising:

a printing head that uses a pressure change by an application of an electric signal to eject the ink;

a conductive member disposed in a region which faces the printing head;

a voltage applier which applies a voltage to the conductive member for generating an electric field between the printing head and the conductive member; and a controller that causes the printing head to eject the ink onto the printing medium conveyed between the printing head and the conductive member, the electric field being generated therebetween by the voltage applier, wherein the voltage applied to the conductive member by the voltage applier when a first printing medium is used differs from the voltage applied to the conductive member by the voltage applier when a second printing medium thicker than the first printing medium is used, in a case where a distance between the printing head and the first printing medium and a distance between the printing head and the second printing medium are maintained at a predetermined distance.

2. An inkjet printing apparatus as claimed in claim 1, wherein the voltage applied to the conductive member by the voltage applier when the second printing medium is used is higher than the voltage applied to the conductive member by the voltage applier when the first printing medium is used.

3. An inkjet printing apparatus which ejects ink to a printing medium to perform printing on the printing medium, the apparatus comprising:

a printing head that uses a pressure change by an application of an electric signal to eject the ink;

a conductive member disposed in a region which faces the printing head;

a voltage applier which applies a voltage to the conductive member for generating an electric field between the printing head and the conductive member; and a controller that causes the printing head to eject the ink onto the printing medium conveyed between the printing head and the conductive member, the electric field being generated therebetween by the voltage applier, wherein the voltage applier controls the voltage applied to the conductive member in accordance with thicknesses of printing medium when a distance between the printing head and printing media having different thicknesses is maintained at a predetermined distance.

4. An inkjet printing apparatus as claimed in claim 3, wherein the voltage applier controls the voltage applied to the conductive member in accordance with information on a distance between a face of the printing head where ejection openings are formed and a surface of the printing medium.

5. An inkjet printing apparatus according to claim 1, wherein the conductive member supports the printing medium and is electrically connected to the voltage applier.

6. An inkjet printing apparatus according to claim 3, wherein the conductive member supports the printing medium and is electrically connected to the voltage applier.

* * * * *